US008461820B2

(12) United States Patent
Fieldhouse et al.

(10) Patent No.: US 8,461,820 B2
(45) Date of Patent: Jun. 11, 2013

(54) PERTURB VOLTAGE AS A DECREASING NON-LINEAR FUNCTION OF CONVERTER POWER

(75) Inventors: Jeffrey Alan Fieldhouse, Burnaby (CA); Zoran Miletic, Belgrade (RS)

(73) Assignee: Schneider Electric USA, Inc., Palatine, IL (US)

( * ) Notice: Subject to any disclaimer, the term of this patent is extended or adjusted under 35 U.S.C. 154(b) by 1184 days.

(21) Appl. No.: 12/320,064

(22) Filed: Jan. 15, 2009

(65) Prior Publication Data

US 2010/0176771 A1 Jul. 15, 2010

(51) Int. Cl.
*G05F 5/00* (2006.01)

(52) U.S. Cl.
USPC ..... 323/299; 323/906

(58) Field of Classification Search
USPC ..... 323/283, 285, 299, 351, 906; 700/286, 700/297, 298
See application file for complete search history.

(56) References Cited

U.S. PATENT DOCUMENTS

| | | | | |
|---|---|---|---|---|
| 3,795,858 | A | 3/1974 | Fletcher et al. | |
| 4,404,472 | A | 9/1983 | Steigerwald | |
| 4,700,285 | A * | 10/1987 | Szepesi | 363/97 |
| 5,604,430 | A | 2/1997 | Decker et al. | |
| 5,917,711 | A | 6/1999 | Shikata et al. | |
| 5,932,938 | A | 8/1999 | Shimamori | |
| 5,932,994 | A * | 8/1999 | Jo et al. | 323/222 |
| 6,104,104 | A | 8/2000 | Kuroki | |
| 6,111,391 | A | 8/2000 | Cullen | |
| 6,183,131 | B1 * | 2/2001 | Holloway et al. | 374/172 |
| 6,204,645 | B1 | 3/2001 | Cullen | |
| 6,255,804 | B1 | 7/2001 | Herniter et al. | |
| 6,690,590 | B2 | 2/2004 | Stamenic et al. | |
| 6,882,131 | B1 | 4/2005 | Takada et al. | |
| 6,917,185 | B2 | 7/2005 | Okamoto | |
| 6,984,970 | B2 | 1/2006 | Capel | |
| 7,091,707 | B2 | 8/2006 | Cutler | |
| 7,193,872 | B2 | 3/2007 | Siri | |
| 7,432,691 | B2 | 10/2008 | Cutler | |
| 2005/0068012 | A1 * | 3/2005 | Cutler | 323/234 |

OTHER PUBLICATIONS

Sera et al., "Improving MPPT Algorithms for Rapidly Changing Environmental Conditions", Power Electronics and Motion Control Conference, 2006, Aug. 30-Sep. 1, 2006, pp. 1614-1619.
H. Knopf, "Analysis, Simulation, and Evaluation of Maximum Power Point Tracking (MPPT) Methods for a Solar Powered Vehicle, " Thesis, Portland State Uni. 1999.
H. Cutler et al., "Implementation and Testing of the Upgraded Suntie XR-Version 5.0 Used in Single Photovoltaic Systems," STXR-V5 White Paper, Revision A, Apr. 8, 2003, 7 pages.
X. Sun et al, "A Research on Photovoltaic Energy Controlling System with Maximum Power Point Tracking," IEEE, 2002, pp. 822-826.

* cited by examiner

*Primary Examiner* — Gary L Laxton
(74) *Attorney, Agent, or Firm* — Nixon Peabody LLP

(57) ABSTRACT

Methods, apparatus and media for controlling a switching circuit controlling an amount of power drawn from an energy converter, to optimize the amount of power drawn from the energy converter. An output voltage and an output current of the energy converter are measured to produce signals representing converter output voltage and current. Converter power is calculated from the product of the converter output voltage and current. A perturb voltage is calculated as a decreasing nonlinear function of the converter power. A new reference voltage signal representing a desired converter output voltage is produced in response to a previous reference voltage signal and the perturb voltage. The reference voltage signal is used by the switching circuit to adjust the power drawn from the converter to achieve the desired converter output voltage.

52 Claims, 7 Drawing Sheets

$$V_{STEP} = ((a/(b + P_{CONVERTER}/c)) - d$$

FIG. 6

$$V_{STEP} = (7/(1 + P_{ARRAY\ AVG}/1600)) - 2$$

FIG. 7

PERTURB VOLTAGE AS A DECREASING NON-LINEAR FUNCTION OF CONVERTER POWER

BACKGROUND OF THE INVENTION

1. Field of Invention

This invention relates to energy conversion and more particularly to methods and apparatus for controlling power drawn from an energy converter operable to convert energy from a physical source into electrical energy and more particularly to using a perturb voltage produced according to a decreasing non-linear function of converter power to control the power drawn from the energy converter.

2. Description of Related Art

Energy conversion devices such as photovoltaic arrays are commonly used to provide power to electrical loads. Often, these loads are direct current (DC) loads such as batteries, for example. In order to efficiently utilize the energy conversion device, maximum power should be provided from the energy conversion device to the load. The maximum power available to be provided to the load depends upon the conditions under which the energy conversion device is operated and in the case of a photovoltaic array, these conditions include the amount of insolation and the temperature of the array, for example. A maximum power point, or voltage at which maximum power may be extracted from the array, is a desirable point at which to operate the array and conventional systems seek to find this point. The maximum power point changes however, due to changes in insolation and due to changes in temperature of the array and thus control systems are employed to constantly seek this point.

One way of seeking the maximum power point is to periodically perturb and observe the power output of the array and then adjust the power demanded from the array accordingly to cause the voltage of the array to be as close as possible to the maximum power point. Typically, such perturb and observe methodologies involve perturbing the present power supplied to the load by a fixed amount and then observing the effect on power supplied by the array and the voltage measured at the array. Perturbing typically involves temporarily increasing or decreasing the power supplied to the load by a fixed amount, for example. If, after increasing power demanded from the array, the change in power is negative and voltage measured at the array drops by a significant amount, too much power is being extracted from the array and the power demand on the array must be reduced, in which case the power drawn by the array is usually reduced by a fixed amount. If the voltage does not change by a significant amount when the power is perturbed, perhaps not enough power is being extracted from the array and the present power drawn from the array must be increased in which case the power demanded from the array is usually increased by a fixed amount.

Changes in the maximum power available from the array can be dramatic and instantaneous, from 200 watts to 2000 watts in a matter of seconds, for example. This situation may occur due to a change in the amount of insolation, such as may occur when a cloud moves or dissipates from a position blocking sunlight shining on the array to a position in which full sunlight is received on the array. With fixed 4 watt power increments, and a perturb and observe period of 50 milliseconds, the time to change the power drawn from the array from 200 watts to 2000 watts would be about 22 seconds. During this period the full available power is not being drawn from the array, resulting in inefficient operation. If the array is operating at higher power levels, say at 1600 watts, and the maximum power available changes to 2000 watts due to a change in the amount of insolation, the time required to change the power drawn from the array from 1600 watts to 2000 watts would be only about 5 seconds. Therefore it can be seen that when the array is operating at lower power levels, the increased time needed to determine the maximum power point with a fixed incremental value can result in inefficient operation of the array.

SUMMARY OF THE INVENTION

In accordance with one aspect of the invention there is provided a method for controlling a switching circuit controlling the amount of power drawn from an energy converter, to optimize the amount of power drawn from the energy converter. The method involves measuring an output voltage and an output current of the energy converter to produce signals representing converter output voltage and converter output current. The method also involves calculating converter power from the product of the converter output voltage and the converter output current and calculating a perturb voltage as a decreasing nonlinear function of the converter power. The method further involves producing a new reference voltage signal representing a desired converter output voltage, in response to a previous reference voltage signal and the perturb voltage. The new reference voltage signal is used by the switching circuit to adjust the power drawn from the converter to achieve the desired converter output voltage.

The method may further involve sampling the output voltage and sampling the output current to produce sampled voltage and sampled current values.

The method may further involve calculating converter power sample values in response to corresponding sampled voltage and sampled current values, accumulating a plurality of successive power sample values for a period of time dependent upon the power sample values, and determining an average power value in response to the plurality of successive power sample values accumulated during the period of time.

The period of time may be inversely proportional to a power represented by at least one of the power sample values.

The method may further involve classifying the power sample values into one of a plurality of power value ranges and setting the period of time according to a current power sample value range.

The nonlinear function of converter power may include a piecewise linear function of converter power.

The nonlinear function of converter power may include a hyperbolic function of converter power.

The hyperbolic function may be generally represented by:

$$V\text{step}=((a/(b+P\text{converter}/c))-d;$$

wherein

Vstep=perturb voltage;

Pconverter=Converter Power;

a=a variable between about 5 and about 9;

b=a variable between 0 and about 3;

c=a variable between about 1000 and about 2000; and d=a variable between about 1 and about 3.

The method may further involve normalizing the perturb voltage and clamping the perturb voltage within a range.

Producing the reference voltage signal may involve increasing or decreasing a previously produced reference voltage signal by an amount corresponding to the perturb voltage.

The method may further involve preventing a pre-determined number of successive increases or successive decreases in the previously produced reference voltage signal.

Preventing the pre-determined number of successive increases or successive decreases may involve storing a previously calculated converter power value, comparing the calculated converter power value with the previously calculated power value to determine whether the calculated converter power value is increasing or decreasing, and counting successive increases in the calculated converter power value to produce a direction count value. Preventing the pre-determined number of successive increases may further involve changing a sign of a direction variable when the direction count value meets a criterion, producing a perturb voltage addend as the product of the direction variable and the perturb voltage, adding the perturb voltage addend to the previously calculated reference voltage signal to produce a new reference voltage value, and producing the new reference voltage signal in response to the new reference voltage value.

The method may further involve providing the reference voltage signal to the switching circuit.

In another aspect of the invention there is provided an apparatus for controlling an amount of power drawn from an energy converter by an energy transfer device having a switching circuit from an energy converter, to optimize the amount of power drawn from the energy converter. The apparatus including a voltage sensor to measure the converter output voltage, a current sensor to measure the converter output current, and a processor, in communication with the voltage sensor and the current sensor. The processor is operably configured to calculate converter power from the product of the converter output voltage and the converter output current, calculate a perturb voltage as a decreasing nonlinear function of the converter power, and produce a new reference voltage signal representing a desired converter output voltage, in response to a previous reference voltage signal and the perturb voltage. The reference voltage signal is used by the switching circuit to adjust the power drawn from the converter to achieve the desired converter output voltage.

The processor may further be operably configured to sample the converter output voltage and the converter output current to produce respective sampled voltage and sampled current values.

The processor may further be operably configured to calculate converter power sample values in response to corresponding sampled voltage and sampled current values, cause a plurality of successive power sample values to be accumulated for a period of time dependent upon the power sample values, and determine an average power value in response to the plurality of successive power sample values accumulated during the period of time.

The period of time may be inversely proportional to a power represented by at least one of the power sample values.

The processor may further be operably configured to classify the power sample values into one of a plurality of power value ranges and to set the period of time according to a current power sample value range.

The nonlinear function of converter power may include a piecewise linear function of converter power.

The nonlinear function of converter power may include a hyperbolic function of converter power.

The hyperbolic function may be generally represented by:

$$V\text{step}=((a/(b+P\text{converter}/c))-d;$$

wherein

Vstep=perturb voltage;

Pconverter=Converter Power;

a=a variable between about 5 and about 9;

b=a variable between 0 and about 3;

c=a variable between about 1000 and about 2000; and d=a variable between about 1 and about 3.

The processor may be operably configured to normalize the perturb voltage and clamp the perturb voltage within a range.

The processor may be operably configured to increase or decrease a previously produced reference voltage signal by an amount corresponding to the perturb voltage.

The processor may be operably configured to prevent a pre-determined number of successive increases or successive decreases in the previously produced reference voltage signal.

The processor may be operably configured to store a previously calculated converter power value, compare the calculated converter power value with the previously calculated power value to determine whether the calculated converter power value is increasing or decreasing, and count successive increases in the calculated converter power value to produce a direction count value. The process may further be operably configured to change a sign of a direction variable when the direction count value meets a criterion, produce a perturb voltage addend as the product of the direction variable and the perturb voltage, add the perturb voltage addend to the previously calculated reference voltage signal to produce a new reference voltage value, and produce the new reference voltage signal in response to the new reference voltage value.

The apparatus further includes a signal coupler for coupling the reference voltage signal to the switching circuit.

In accordance with another aspect of the invention there is provided an apparatus for controlling the amount of power drawn from an energy converter, to optimize the amount of power drawn from the energy converter. The apparatus includes provisions for measuring an output voltage and an output current of the energy converter to produce signals representing converter output voltage and converter output current, provisions for calculating converter power from the product of the converter output voltage and the converter output current, provisions for calculating a perturb voltage as a decreasing nonlinear function of the converter power, and provisions for producing a new reference voltage signal representing a desired converter output voltage, in response to a previous reference voltage signal and the perturb voltage, for use by a switching circuit to adjust the power drawn from the converter to achieve the desired converter output voltage.

The provisions for measuring the output voltage and measuring the output current may include provisions for sampling the output voltage and for sampling the output current to produce sampled voltage and sampled current values.

The apparatus may further include provisions for calculating converter power sample values in response to corresponding sampled voltage and sampled current values, provisions for accumulating a plurality of successive power sample values for a period of time dependent upon the power sample values, and provisions for determining an average power value in response to the plurality of successive power sample values accumulated during the period of time.

The period of time may be inversely proportional to a power represented by said power sample values.

The apparatus may further include provisions for classifying the power sample values into one of a plurality of power value ranges and setting the period of time according to a current power sample value range.

The nonlinear function of converter power may include a piecewise linear function of converter power.

The nonlinear function of converter power includes a hyperbolic function of converter power.

The hyperbolic function may be generally represented by:

$$V\text{step}=((a/(b+P\text{converter}/c))-d;$$

wherein

Vstep=perturb voltage;

Pconverter=Converter Power;

a=a variable between about 5 and about 9;

b=a variable between 0 and about 3;

c=a variable between about 1000 and about 2000; and d=a variable between about 1 and about 3.

The apparatus may further include provisions for normalizing the perturb voltage and clamping the perturb voltage within a range.

The provisions for producing the reference voltage signal may include increasing or decreasing a previously produced reference voltage signal by an amount corresponding to the perturb voltage.

The apparatus may further include provisions for preventing a pre-determined number of successive increases or successive decreases in the previously produced reference voltage signal.

The provisions for preventing the pre-determined number of successive increases or successive decreases in the previously produced reference voltage signal may include provisions for storing a previously calculated converter power value, provisions for comparing the calculated converter power value with the previously calculated power value to determine whether the calculated converter power value is increasing or decreasing, and provisions for counting successive increases in the calculated converter power value to produce a direction count value. The provisions for preventing the pre-determined number of successive increases and decreases may further include provisions for changing a sign of a direction variable when the direction count value meets a criterion, provisions for producing a perturb voltage addend as the product of the direction variable and the perturb voltage, provisions for adding the perturb voltage addend to the previously calculated reference voltage signal to produce a new reference voltage value, and provisions for producing the reference voltage signal in response to the new reference voltage value.

The apparatus may further include provisions for providing the reference voltage signal to the switching circuit.

In accordance with another aspect of the invention there is provided a computer readable medium encoded with codes for directing a processor to produce a signal for controlling a switching circuit controlling the amount of power drawn from an energy converter, to optimize the amount of power drawn from the energy converter. The codes include codes for directing the processor to receive signals representing converter output voltage and converter output current, calculate a converter power value from the product of the converter output voltage and the converter output current, calculate a perturb voltage as a decreasing nonlinear function of the converter power, and produce a new reference voltage signal representing a desired converter output voltage, in response to a previous reference voltage signal and the perturb voltage, for use by the switching circuit to adjust the power drawn from the converter to achieve the desired converter output voltage.

The signals representing converter output voltage and converter output current may be sampled output voltage and sampled output current signals respectively.

The computer readable medium may further include codes for directing the processor to calculate converter power sample values in response to corresponding sampled voltage and sampled current values, accumulate a plurality of successive power sample values for a period of time dependent upon the power sample values, and determine an average power value in response to the plurality of successive power sample values accumulated during the period of time.

The period of time may be inversely proportional to a power represented by at least one of the power sample values.

The computer readable medium may further include codes for directing the processor to classify the power sample values into one of a plurality of power value ranges and setting the period of time according to a current power sample value range.

The nonlinear function of converter power may include a piecewise linear function of converter power.

The nonlinear function of converter power may include a hyperbolic function of converter power.

The hyperbolic function may be generally represented by:

$$V\text{step}=((a/(b+P\text{converter}/c))-d;$$

wherein

Vstep=perturb voltage;

Pconverter=Converter Power;

a=a variable between about 5 and about 9;

b=a variable between 0 and about 3;

c=a variable between about 1000 and about 2000; and d=a variable between about 1 and about 3.

The computer readable medium may further include codes for directing the processor to normalize the perturb voltage and clamp the perturb voltage within a range.

The computer readable medium may further include codes for directing the processor to increase or decrease a previously produced reference voltage signal by an amount corresponding to the perturb voltage.

The computer readable medium may further include codes for directing the processor to prevent a pre-determined number of successive increases or successive decreases in the previously produced reference voltage signal The computer readable medium may further include codes for directing the processor to store a previously calculated converter power value, compare the calculated converter power value with the previously calculated power value to determine whether the calculated converter power value is increasing or decreasing, and count successive increases in the calculated converter power value to produce a direction count value. The computer readable medium may further include codes for directing the processor to change a sign of a direction variable when the direction count value meets a criterion, produce a perturb voltage addend as the product of the direction variable and the perturb voltage, add the perturb voltage addend to the previously calculated reference voltage signal to produce a new reference voltage value, and produce the new reference voltage signal in response to the new reference voltage value.

The computer readable medium may further include codes directing the processor to provide the reference voltage signal to the switching circuit.

BRIEF DESCRIPTION OF THE DRAWINGS

In drawings which illustrate embodiments of the invention,

FIG. 6 is an example of a function according to which a voltage step size value or a perturb step voltage can be calculated.

FIG. 7 is another example of a function according to which a voltage step size value or a perturb step voltage can be calculated.

DETAILED DESCRIPTION

Figure 1:
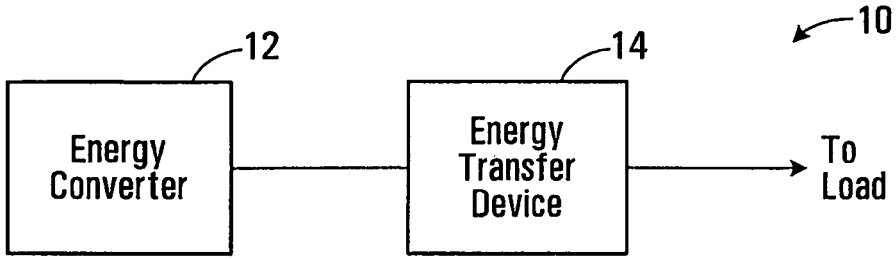
FIG. 1 is a block diagram of an energy supply system according to a first embodiment of the invention.

Referring to FIG. 1 an energy supply system according to a first embodiment of the invention is shown generally at 10. The system includes an energy converter 12 and an energy transfer device 14 which, together, cooperate to supply energy to a load.

The energy converter 12 is of a general class of energy conversion devices that are able to supply electrical power in response to a supply of physical energy. Such devices are able to be operated under conditions where the supply voltage and supply current produced by the device are optimized such that for a given physical power input a maximum electrical power, i.e. a maximum working power is produced. The supply current and supply voltage conditions under which maximum working power can be extracted from the energy conversion device vary depending upon the physical power available and operating conditions of the device.

Figure 2:
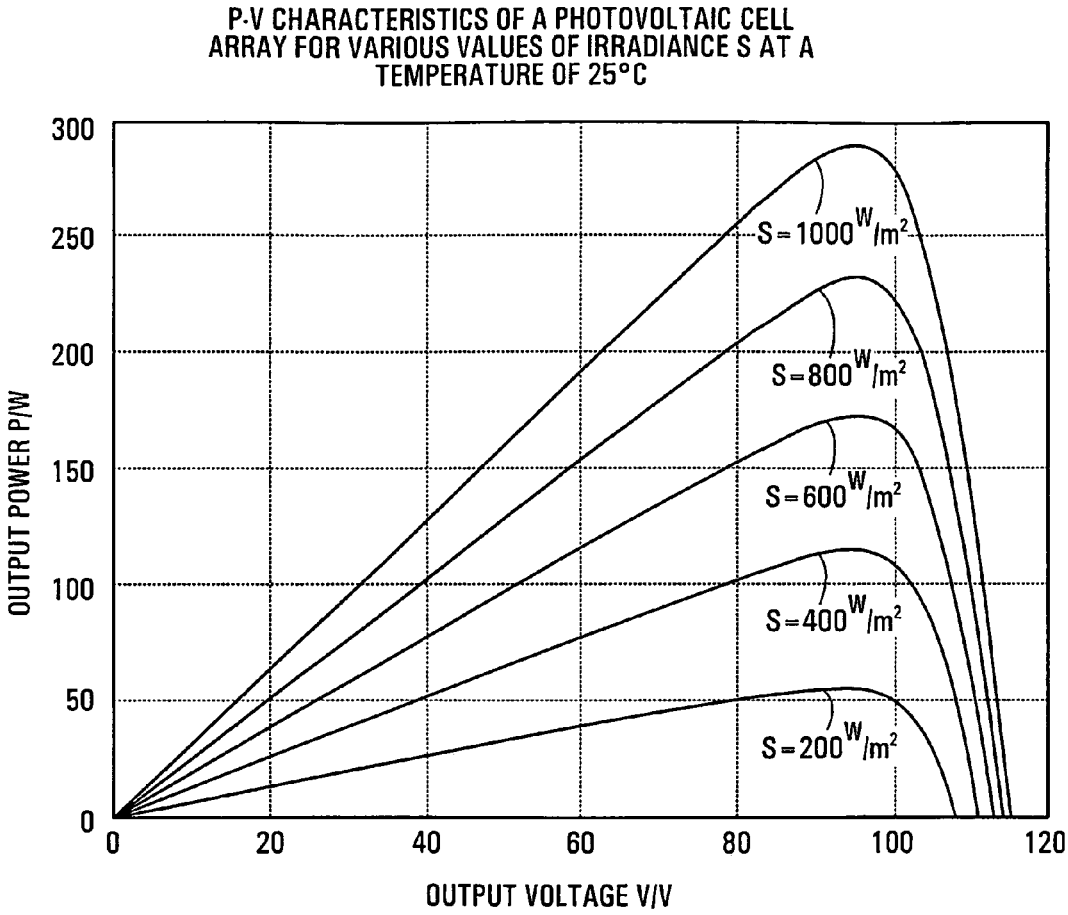
FIG. 2 is a graph of power-voltage characteristics of a photovoltaic cell array for various values of insolation S at a temperature of 25 degrees Celcius.

For example, the energy converter 12 may include a photovoltaic array and the energy transfer device 14 may include a DC to DC converter for supplying electrical energy to a DC load such as a power bus.

Where the energy converter 12 includes a photovoltaic array, physical energy in the form of light energy is converted by the photovoltaic array into electrical energy. The maximum working power that can be drawn from the photovoltaic array depends upon the physical power available, i.e. the amount of light insolating the array and the temperature of the array. For every insolation and temperature combination there is a maximum power point at which the supply voltage and supply current produced by the array are optimized to cause maximum energy conversion efficiency, or in other words to allow the most working power possible to be drawn from the array. Changes in voltage at the array are effected by changes in the amount of current drawn from the array. In general, the greater the current draw, the less the voltage. Since the power drawn from the array may be calculated as the product of the current and voltage at the array, the power output of the array may be plotted relative to voltage as shown in FIG. 2, for various levels of insolation. From FIG. 2 it can be seen that the power output of the photovoltaic array increases to a point and then decreases with increasing array voltage. The point at which the power is the greatest is the maximum power point. The embodiment described herein seeks to find this maximum power point and regulate the output voltage of the array to maintain it.

Figure 3:
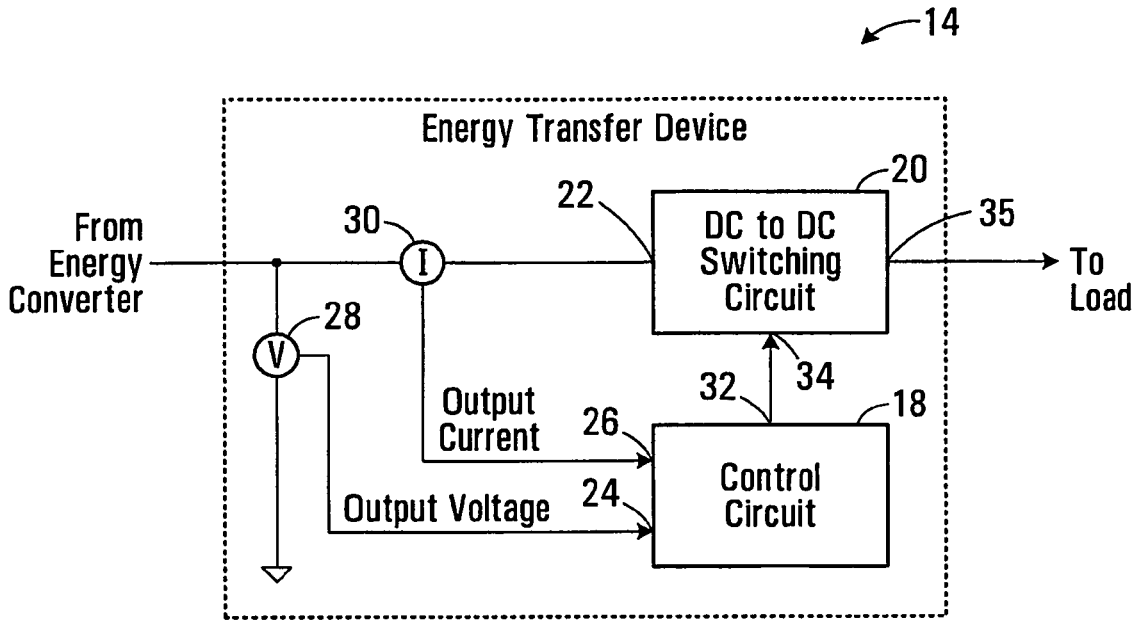
FIG. 3 is a block diagram of an energy transfer device according to an embodiment of the invention.

Referring to FIG. 3, an energy transfer device according to one embodiment of the invention is shown generally at 14 and includes a control circuit 18 and a DC to DC switching circuit 20. The DC to DC switching circuit 20 has an input 22 for receiving power from the energy converter 12 shown in FIG. 1.

The control circuit 18 has a voltage input 24 and a current input 26 for receiving output voltage and output current signals representing output voltage and output current respectively of the energy converter, as measured at the input 22 to the DC to DC switching circuit 20. For illustrative purposes, a voltage sensor 28 is connected to the input 22 for producing the output voltage signal received at the voltage input 24 and a current sensor 30 is shown in series with the input 22 for developing the output current signal received at the current input 26. The control circuit 18 also has an output 32 at which a reference voltage signal is produced, the reference voltage signal representing a desired converter output voltage.

The reference voltage signal is provided to the DC to DC switching circuit 20 through a control input 34 on the DC to DC switching circuit, for receiving the reference voltage signal. The DC to DC switching circuit 20 controls switching transistors therein (not shown) to increase and decrease the amount of current drawn at the input 22 and provided to an output terminal 35 of the DC to DC switching circuit, connected to the load.

Effectively, the voltage sensor 28 and the current sensor 30 measure an output voltage and an output current of the energy converter to produce signals representing converter output voltage and converter output current respectively. The voltage sensor 28 and the current sensor 30 measure the converter output voltage and the converter output current by sampling the converter output voltage and the converter output current to produce sampled voltage and sampled current values respectively. The control circuit 18 receives the signals representing the converter output voltage and the converter output current and calculates a converter power from the product of the converter output voltage and the converter output current. The control circuit 18 then calculates a perturb voltage as a decreasing non-linear function of the calculated converter power and produces a reference voltage signal at the output 32, representing a desired converter output voltage in response to a previously produced reference voltage signal and the just calculated perturb voltage, for use by the switching circuit 20, to adjust the power drawn from the energy converter to achieve the desired converter output voltage.

Figure 4:
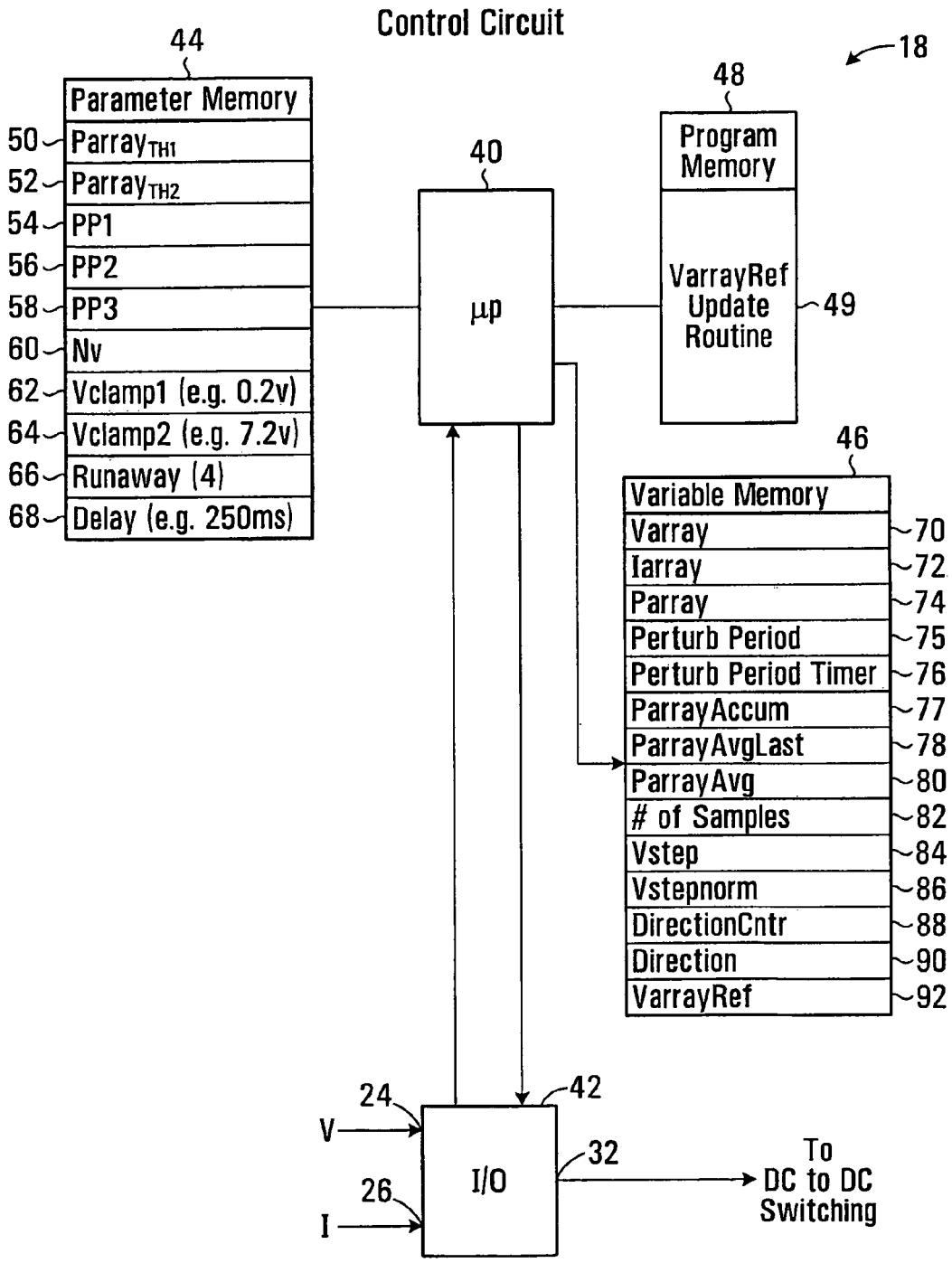
FIG. 4 is a block diagram of a control circuit of the energy transfer device shown in FIG. 3.

Referring to FIG. 4, the control circuit 18 is shown in greater detail. In this embodiment, the control circuit 18 includes a microprocessor 40, and an I/O device 42, parameter memory 44, variable memory 46, and program memory 48 all in communication with the microprocessor.

In this embodiment the I/O device 42 includes the voltage and current inputs 24 and 26 respectively and includes the output 32 for providing the reference voltage signal that is provided to the DC to DC switching circuit (20). The input signals representing the output voltage and the output current of the energy converter received at the voltage and current inputs 24 and 26 respectively may be voltage or current signals, for example, and in the case of voltage signals may be in the range of 0 to 5 volts or 0 to 10 volts, for example, or in the case of current signals in the range of 4 to 20 milliamps, for example. In such case, the I/O device 42 may include circuitry (not shown) to provide for scaling to provide voltage signals compatible with a semiconductor device (not shown) of the I/O device operable to communicate with the microprocessor 40. Similarly, the output 32 may be operable to provide a signal in the range of 0 to 5 volts or 0 to 10 volts, for example, or may be operable to provide a pulse width modulated signal representing the reference voltage, for example.

The parameter memory 44 includes predefined memory locations, also referred to as registers, for storing various "fixed" parameters for use by the microprocessor 40. These registers include an array power value register 50 associated with a first threshold, an array power value register 52 associated with a second threshold, a first perturb period value register 54, a second perturb period value register 56, and a third perturb period value register 58. The registers further include a normalization register 60, a first clamp voltage register 62, a second clamp voltage register 64, a runaway register 66 and a delay register 68. The array power value registers 50 and 52 hold array power threshold values for use in setting perturb periods dependent on the current power calculated to be drawn from the array. The perturb period value registers 54, 56 and 58 hold perturb period time values representing respective time periods to allow a power perturbation to exist. The normalization register 60 holds a normalized voltage reference value for normalizing a step voltage to be used during a perturbation period. The clamp voltage registers 62 and 64 hold voltage clamp values for maintaining the step voltage within predefined limits. The runaway register 66 holds a number representing the number of times a perturbation can occur in an increasing direction or a decreasing direction before the direction of perturbation is changed. The delay register 68 holds a delay value representing a time to wait between successive calculations of new perturbations.

The variable memory 46 includes an array voltage register 70, an array current register 72, an array power register 74, a perturb period register 75, a perturb period timer register 76, an array power accumulator register 77, a last average array power register 78, a average array power register 80, a number of samples register 82, a voltage step size register 84, a normalized step voltage register 86, a direction counter register 88, a direction register 90, and an array reference voltage register 92. The array voltage and array current registers 70 and 72 hold measured array voltage and measured array current, respectively, represented by the signals received at the inputs 24 and 26 respectively of the I/O device 42. The array power register 74 holds a value representing calculated array power, calculated from the contents of the array voltage and array current registers 70 and 72. The perturb period register 75 holds a value representing the current period between perturbations and the perturb period timer register 76 holds a value representing the time elapsed since a current perturb period started. The array power accumulator register 77 holds a value representing a sum of previously calculated array power values for the purposes of calculating an average value later. The last average array power register 78 holds a value representing the last calculated average array power. The average array power register 80 holds a value representing the current calculated average array power. The number of samples register 82 holds a value representing the number of samples of voltage and current values received, for the purpose of calculating the average array power. The voltage step size register 84 holds a value representing a voltage step increase or decrease, or in other words, an amount by which the reference voltage signal is perturbed in order to increase or decrease power drawn from the energy converter (12). The normalized step voltage register 86 holds a value representing the contents of the voltage step size register 84 normalized by the contents of the normalization register 60 of the parameter memory 44. The direction counter register 88 holds a value representing a count of the number of times the voltage has successively been perturbed in the same direction. The direction register 90 holds a value such as +1 or −1, representing the direction in which the reference voltage is tending, i.e. increasing or decreasing. The array reference voltage register 92 holds a value representing the reference voltage signal representing a desired array output voltage.

The program memory 48 includes a computer readable medium encoded with codes 49 for directing the microprocessor 40 to execute an array voltage reference update routine to update the reference voltage signal produced at the output 32 to maintain the power drawn from the energy convertor (12) at the maximum power point.

Figure 5A:
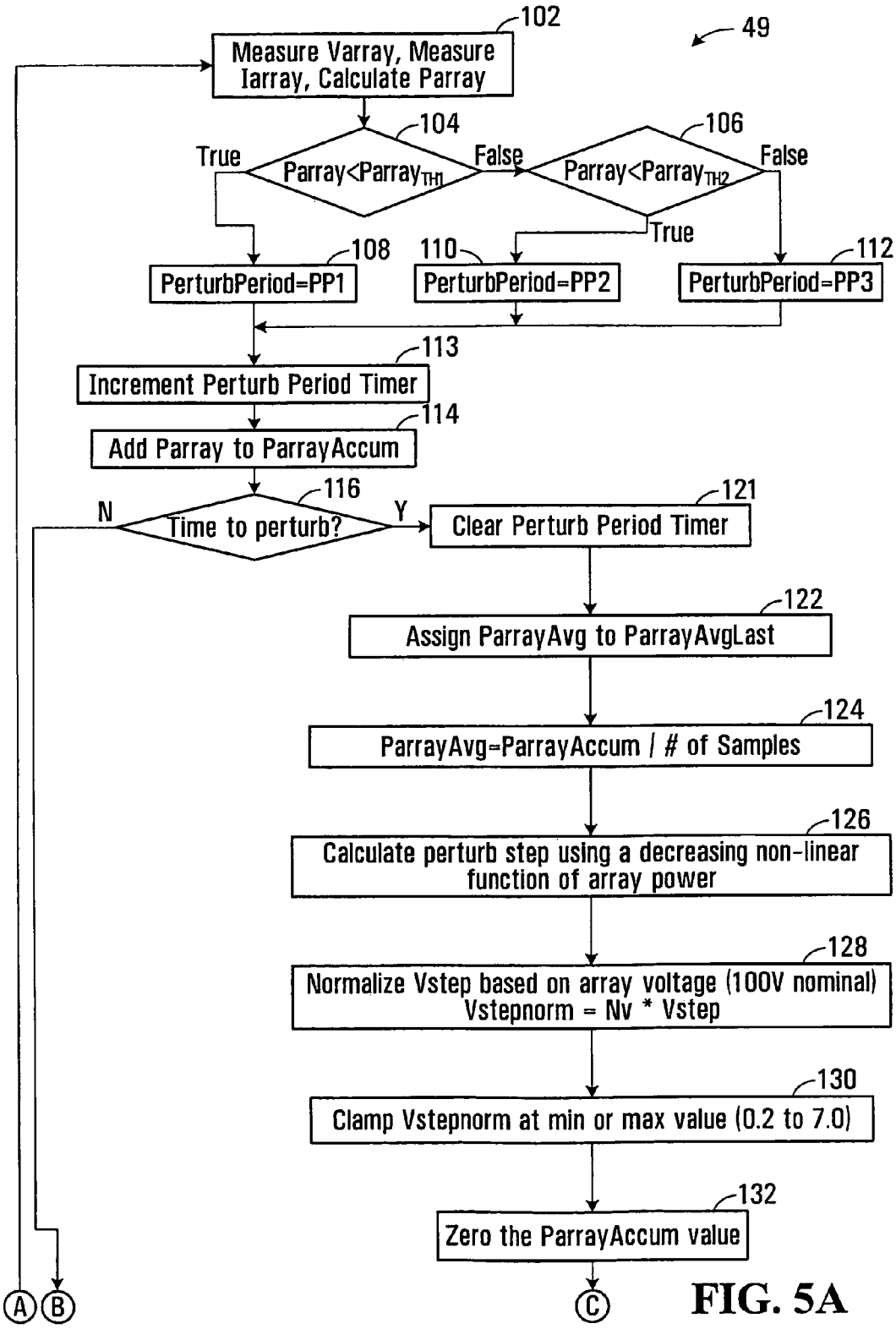
FIG. 5A is a first part of a flow chart of an array reference voltage update routine according to an embodiment of the invention.

Referring to FIGS. 4 and 5A, the array reference voltage update routine is shown in detail at 49. The routine 49 begins with a first block 102 that directs the microprocessor 40 to communicate with the I/O device 42 to sample the signals received at the voltage and current inputs 24 and 26 and to store these values in the array voltage and array current registers 70 and 72 respectively. Also, as part of this first block, the microprocessor 40 is directed to calculate an array power value as the product of the contents of the array voltage and array current registers 70 and 72 and to store the calculated array power value in the array power register 74. Effectively, a converter power sample value is calculated in response to corresponding sampled voltage and sampled current values.

Next, blocks 104 and 106 direct the microprocessor 40 to determine whether the current array power value stored in the array power register 74 falls within one of three ranges, in this embodiment. The first range is from 0 to the array power value associated with the first threshold value stored in register 50, the second range is between the array power value associated with the first threshold value and the array power value associated with the second threshold value stored in register 52, and the third range is between the array power value associated with the second threshold value and the maximum power rating of the DC to DC switching circuit (20). The first range may be 0 to 500 w, the second range may be 500 w to 3500 w and the third range may be 3500 w to infinity, for example. Thus, the current array power value stored in the array power register 74 is classified into one of a plurality of power value ranges. Essentially, when the array power value is in the first range, block 108 directs the microprocessor 40 to set the contents of the perturb period register 75 equal to the first perturb period value stored in register 54. When the array power is in the second range, block 110 directs the microprocessor 40 to store the contents of the second perturb period register 56 in the perturb period register 75 and when the array power is in the third range, block 112 directs the microprocessor 40 to store the contents of the third perturb period value register 58 in the perturb period register. Thus, the contents of the perturb period register 75 are determined based on the currently measured array power as provided by the contents of the array power register 74. The contents of the first, second and third perturb period registers may be 16 s, 8 s and 4 s for example, such that a longer perturb period is associated with a lower range of array power, a shorter perturb period is associated with a mid range of array power and an even shutter perturb period is associated with the highest range of array power Once the perturb period has been set as described above, block 113 directs the microprocessor 40 to increment a perturb period timer. Block 114 then directs the microprocessor 40 to add the current array power value stored in the array power register 74 to the array power accumulator register 77.

The array power accumulator register 77 accumulates a plurality of successive power sample values during the perturb period stored in the perturb period register 75. Block 116 then directs the microprocessor 40 to determine whether or not the contents of the perturb period timer register 76 are equal to the contents of the perturb period register 75. If not, the microprocessor 40 is directed to block 118, shown in FIG. 5B, which directs the microprocessor to wait a period of time corresponding to a value stored in the delay register 68. In this embodiment, the delay value is 250 milliseconds. Block 120 then directs the microprocessor 40 to increment the contents of the number of samples register 82 and the microprocessor is directed back to block 102 in FIG. 5A to take another measurement of the array voltage and array current as described above. Thus, in effect, blocks 102 through 120 implement a sampling routine that directs the microprocessor 40 to sample the output voltage and the output current of the energy converter (12) to produce sampled voltage and sampled current values and to use those values to produce respective array power values and to accumulate the array power values in the array power accumulator register 77.

Referring back to FIG. 5A, if at block 116 the microprocessor 40 determines it is time to perturb, i.e. the contents of the perturb period timer register 76 equal the contents of the perturb period register 75, block 121 directs the microprocessor to clear the contents of the perturb period timer register 76. Block 122 then directs the microprocessor 40 to copy the contents of the average array power register 80 to the contents of the last average array power register 78 and block 124 directs the microprocessor to calculate a new average array power value by dividing the contents of the array power accumulator register 77 by the contents of the number of samples register 82 and to store the result in the average array power register 80. Thus, an average power value is determined in response to a plurality of successive power sample values accumulated during a period of time. The power sample values are classified into one of a plurality of power value ranges by blocks 106 and 108 and the period of time is set according to a range in which the current power sample value is categorized and the period of time is inversely proportional to a power represented by at least one of the power sample values.

Then, block 126 directs the microprocessor 40 to calculate a voltage step size value or a perturb step voltage according to a decreasing non-linear function of array power.

In one embodiment of the invention, the nonlinear function of array power may be a decreasing piecewise linear function of array power. In another embodiment of the invention, the nonlinear function of array power may be a hyperbolic function of array power. For example, the following general function has been found to be suitable:

$$V\text{step}=((a/(b+P\text{converter}/c))-d;$$

wherein

Vstep=perturb voltage;

Pconverter=Converter Power;

a=a variable between about 5 and about 9;

b=a variable between 0 and about 3;

c=a variable between about 1000 and about 2000; and d=a variable between about 1 and about 3.

One particular function that has been found to work well with the array power ranges and erterb periods described above is as follows:

$$V\text{step}=(7/(1+P_{array\ AVG}/1600))-2$$

The calculated perturb step voltage value Vstep is stored in the voltage step size register 84. Block 128 then directs the microprocessor 40 to normalize the voltage step size by multiplying the contents of the voltage step size register 84 by the contents of the normalization register 60. In this embodiment the contents of the normalization register 60 cause the microprocessor 40 to normalize the voltage step size to a value based on a 100 volt nominal reference voltage representing a maximum power point of the array.

Block 130 then directs the microprocessor 40 to clamp the normalized step voltage to a value between first and second clamp voltage limits specified by the contents of the clamp voltage registers 62 and 64 respectively. In this embodiment, the first clamp voltage is 0.2 volts and the second clamp voltage is 7.0 volts. Effectively, the microprocessor 40 normalizes the perturb voltage and clamps the perturb voltage within a range, such that the perturb step voltage is limited to a value between 0.2 volts and 7.0 volts.

Block 132 then directs the microprocessor 40 to set the contents of the array power accumulator register 77 to zero to prepare it to accumulate new array power values.

Figure 5B:
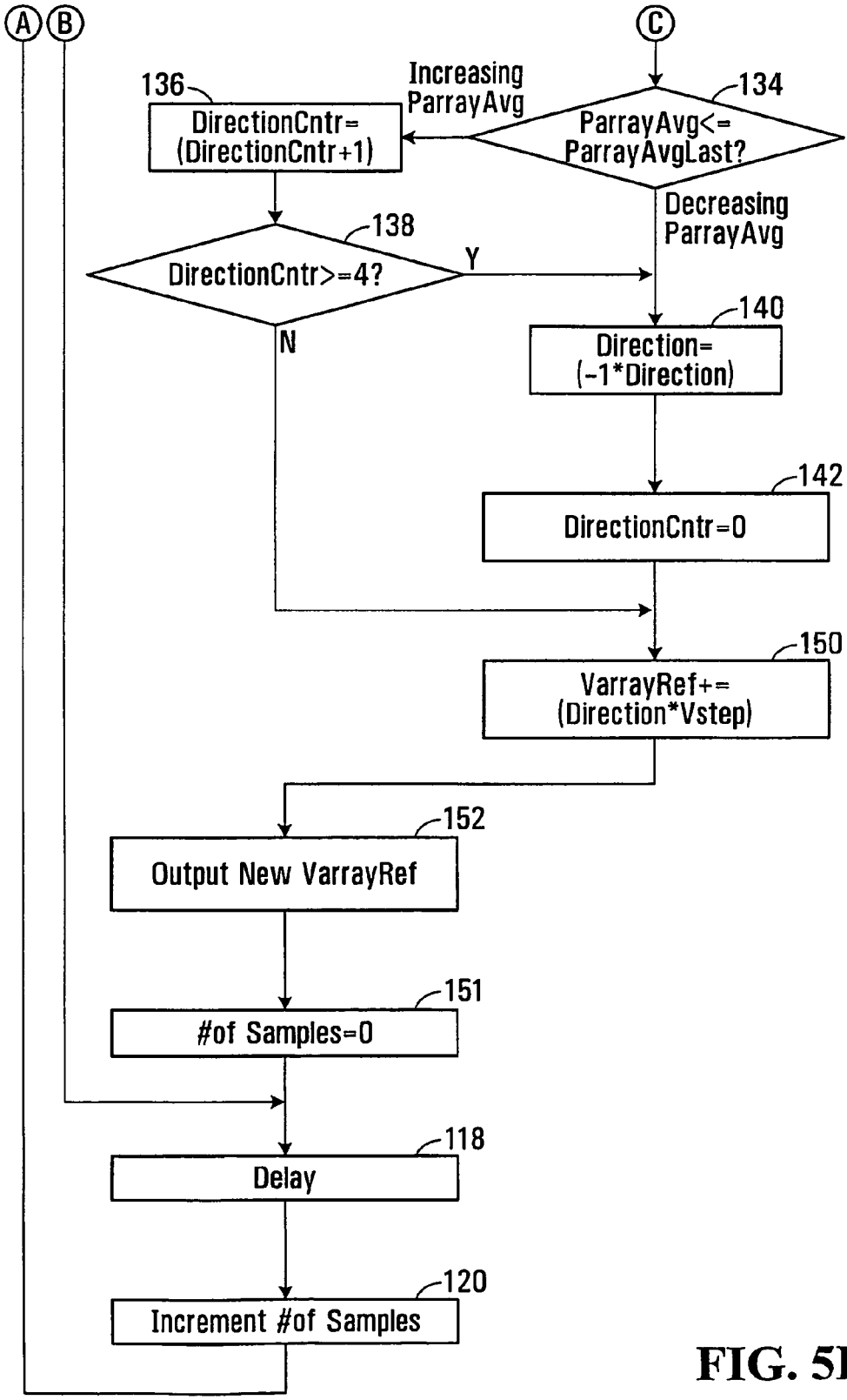
FIG. 5B is a second part of the flow chart shown in FIG. 5A.

Referring to FIG. 5B, block 134 then directs the microprocessor 40 to determine whether or not the average array power value is less than or equal to the last calculated average array power value to determine whether the trend in array power is up or down. This is accomplished by comparing the contents of the average array power register 80 with the contents of the last average array power register 78.

If the average array power is less than or equal to the last average array power, the trend in array power is downward and the microprocessor 40 is directed to block 140 which directs the microprocessor to change the sign of the contents of the direction register 90. The contents of the direction register 90 are thus either "1" or "−1".

Block 142 causes the microprocessor 40 to set the contents of the direction counter register 88 to zero and then block 150 directs the microprocessor 40 to change the contents of the array reference voltage register 92 by calculating a new array reference voltage value as the sum of the product of the contents of the direction register 90 and the contents of the normalized step voltage register 86 and the current contents of the array reference voltage register 92.

If at block 34, the average array power is not less than or equal to the last average array power, the microprocessor 40 is directed to block 136 which directs the microprocessor to set the contents of the direction counter register 88 to its current contents plus one. Block 138 then directs the microprocessor 40 to determine whether the contents of the direction counter register 88 meet a criterion such as whether or not the contents are greater than or equal to some number, such as four, for example as shown. The number represents the number of times the voltage is permitted to be perturbed in an increasing or decreasing direction, before the direction of the reference voltage is reversed.

If at block 138, the contents of the direction register 90 meet the criterion, the processor is directed to block 140 to change the direction value in the direction register 90. Block 142 then directs the microprocessor to set the contents of the direction counter register 88 to zero and block 150 directs the microprocessor 40 to change the contents of the array reference voltage register 92 by calculating a new array reference voltage value as the sum of the product of the contents of the direction register 90 and the contents of the normalized step voltage register 86 and the current contents of the array reference voltage register 92.

Block 152 then directs the microprocessor 40 to communicate with the I/O device 42 to cause a reference voltage signal representing the new contents of the array reference voltage register 92 to be produced at the output 32. Thus, in effect, the reference voltage signal is produced by increasing or decreasing a previously produced reference voltage signal by an amount corresponding to the perturb voltage.

More particularly, the microprocessor 40 is directed to prevent a pre-determined number of successive increases or successive decreases in the previously produced reference voltage signal to avoid a "runaway" effect that could occur during periods of steadily increasing insolation in a photovoltaic energy converter, for example.

Overall, in the embodiment described, a new reference voltage is produced by storing a previously calculated converter power value, comparing the calculated converter power value with the previously calculated power value to determine whether the calculated converter power value is increasing or decreasing, counting successive increases in the calculated converter power value and changing the direction of the power change in the event the power is increased an excessive number of times, and adding a perturb voltage addend, which is calculated as the product of the direction variable and the perturb voltage, to the previously calculated reference voltage signal to produce a new reference voltage value, and then producing a final output reference voltage signal in response to the new reference voltage value.

Referring back to FIG. 3, when the reference voltage signal is changed, the DC to DC switching circuit 20 responds by adjusting its switching cycle to draw power from the energy converter (12) to cause the voltage measured at the input 22 to the DC to DC switching circuit to be equal to the value represented by the contents of the array reference voltage register 92.

Finally, the microprocessor 40 is directed to block 118 which causes it to wait a delay period determined by the contents of the delay register 68, and then block 120 directs the microprocessor to increment the contents of the number of samples register 82 and then to return to block 102 to take another sample of the array voltage and array current and to proceed through the entire process again.

At a high level, in this embodiment, the process involves calculating an average power value based on measured voltage and measured current, calculating a perturb step voltage Vstep as a decreasing non-linear function of the calculated average power value and adjusting the current voltage reference signal by the perturb step voltage to increase or decrease the amount of power demanded from the energy converter for a period of time dependent upon a power range in which the calculated instantaneous power lies. The use of the decreasing non-linear function provides for relatively small changes in the reference voltage signal when a relatively large amount of power is being drawn from the energy converter and provides for relatively large changes in the reference voltage signal when a relatively small amount of power is being drawn from the energy converter. This allows the maximum power point to be located quickly and efficiently.

While specific embodiments of the invention have been described and illustrated, such embodiments should be considered illustrative of the invention only and not as limiting the invention as construed in accordance with the accompanying claims.

The embodiments of the invention in which an exclusive property or privilege is claimed are defined as follows:

1. A method for controlling a switching circuit controlling an amount of power drawn from an energy converter, the method comprising:

measuring an output voltage and an output current of the energy converter to produce signals representing converter output voltage and converter output current;

calculating converter power from the product of said converter output voltage and said converter output current;

calculating a perturb voltage as a decreasing nonlinear function of said converter power; and producing a new reference voltage signal representing a desired converter output voltage, in response to a previous reference voltage signal and said perturb voltage, for use by the switching circuit to adjust the power drawn from the converter to achieve said desired converter output voltage, wherein said decreasing nonlinear function includes a hyperbolic function of converter power, said hyperbolic function being generally represented by: Vstep=((a/(b+Pconverter/c))−d; wherein Vstep=perturb voltage; Pconverter=Converter Power; a=a variable between about 5 and about 9; b=a variable between 0 and about 3; c=a variable between about 1000 and about 2000; and d=a variable between about 1 and about 3.

2. The method of claim 1 wherein measuring said output voltage and measuring said output current comprises sampling said output voltage and sampling said output current to produce sampled voltage and sampled current values.

3. The method of claim 2 further comprising:

calculating converter power sample values in response to corresponding sampled voltage and sampled current values;

accumulating a plurality of successive power sample values for a period of time dependent upon said power sample values; and determining an average power value in response to said plurality of successive power sample values accumulated during said period of time.

4. The method of claim 3 wherein said period of time is inversely proportional to a power represented by at least one of said power sample values.

5. The method of claim 3 further comprising classifying said power sample values into one of a plurality of power value ranges and setting said period of time according to a current power sample value range.

6. The method of claim 1 further comprising normalizing said perturb voltage and clamping said perturb voltage within a range.

7. The method of claim 1 wherein producing said new reference voltage signal comprises increasing or decreasing a previously produced reference voltage signal by an amount corresponding to said perturb voltage.

8. The method of claim 7 further comprising preventing a pre-determined number of successive increases or successive decreases in said previously produced reference voltage signal.

9. The method of claim 1 further comprising providing said reference voltage signal to the switching circuit.

10. A method for controlling a switching circuit controlling an amount of power drawn from an energy converter, the method comprising:

measuring an output voltage and an output current of the energy converter to produce signals representing converter output voltage and converter output current;

calculating converter power from the product of said converter output voltage and said converter output current;

calculating a perturb voltage as a decreasing nonlinear function of said converter power;

producing a new reference voltage signal representing a desired converter output voltage, in response to a previous reference voltage signal and said perturb voltage, for use by the switching circuit to adjust the power drawn from the converter to achieve said desired converter output voltage, said producing including increasing or decreasing a previously produced reference voltage signal by an amount corresponding to said perturb voltage; and preventing a pre-determined number of successive increases or successive decreases in said previously produced reference voltage signal, wherein preventing said pre-determined number of successive increases or successive decreases comprises:

storing a previously calculated converter power value; comparing said calculated converter power value with said previously calculated power value to determine whether said calculated converter power value is increasing or decreasing;

counting successive increases in said calculated converter power value to produce a direction count value;

changing a sign of a direction variable when said direction count value meets a criterion;

producing a perturb voltage addend as the product of said direction variable and said perturb voltage;

adding said perturb voltage addend to said previously calculated reference voltage signal to produce a new reference voltage value; and producing said new reference voltage signal in response to said new reference voltage value.

11. The method of claim 10 wherein said nonlinear function of converter power includes a piecewise linear function of converter power.

12. The method of claim 10 wherein said nonlinear function of converter power includes a hyperbolic function of converter power.

13. The method of claim 12 wherein said hyperbolic function is generally represented by: Vstep=((a/(b+Pconverter/c))−d; wherein Vstep=perturb voltage; Pconverter=Converter Power; a=a variable between about 5 and about 9; b=a variable between 0 and about 3; c=a variable between about 1000 and about 2000; and d=a variable between about 1 and about 3.

14. An apparatus for controlling an amount of power drawn from an energy converter by an energy transfer device having a switching circuit, the apparatus comprising:

a voltage sensor configured to measure a converter output voltage;

a current sensor configured to measure a converter output current;

a processor, in communication with said voltage sensor and said current sensor, said processor being operably configured to:

calculate converter power from the product of said converter output voltage and said converter output current;

calculate a perturb voltage as a decreasing nonlinear function of said converter power; and produce a new reference voltage signal representing a desired converter output voltage, in response to a previous reference voltage signal and said perturb voltage, for use by the switching circuit to adjust the power drawn from the converter to achieve said desired converter output voltage, wherein said decreasing nonlinear function includes a hyperbolic function of converter power, said hyperbolic function being generally represented by: Vstep=((a/(b+Pconverter/c))−d; wherein Vstep=perturb voltage; Pconverter=Converter Power; a=a variable between about 5 and about 9; b=a variable between 0 and about 3; c=a variable between about 1000 and about 2000; and d=a variable between about 1 and about 3.

15. The apparatus of claim 14 wherein said processor is operably configured to sample said converter output voltage and said converter output current to produce respective sampled voltage and sampled current values.

16. The apparatus of claim 15 wherein said processor is operably configured to:

calculate converter power sample values in response to corresponding sampled voltage and sampled current values;

cause a plurality of successive power sample values to be accumulated for a period of time dependent upon said power sample values; and determine an average power value in response to said plurality of successive power sample values accumulated during said period of time.

17. The apparatus of claim 16 wherein said period of time is inversely proportional to a power represented by at least one of said power sample values.

18. The apparatus of claim 16 wherein said processor is operably configured to classify said power sample values into one of a plurality of power value ranges and set said period of time according to a current power sample value range.

19. The apparatus of claim 14 wherein said processor is operably configured to normalize said perturb voltage and clamp said perturb voltage within a range.

20. The apparatus of claim 14 wherein said processor is operably configured to increase or decrease a previously produced reference voltage signal by an amount corresponding to said perturb voltage.

21. The apparatus of claim 20 wherein said processor is operably configured to prevent a pre-determined number of successive increases or successive decreases in said previously produced reference voltage signal.

22. The apparatus of claim 14 further including a signal coupler for coupling said reference voltage signal to the switching circuit.

23. An apparatus for controlling an amount of power drawn from an energy converter by an energy transfer device having a switching circuit, the apparatus comprising:

a voltage sensor configured to measure a converter output voltage;

a current sensor configured to measure a converter output current;

a processor, in communication with said voltage sensor and said current sensor, said processor being operably configured to:

calculate converter power from the product of said converter output voltage and said converter output current;

calculate a perturb voltage as a decreasing nonlinear function of said converter power;

produce a new reference voltage signal representing a desired converter output voltage, in response to a previous reference voltage signal and said perturb voltage, for use by the switching circuit to adjust the power drawn from the converter to achieve said desired converter output voltage;

increase or decrease a previously produced reference voltage signal by an amount corresponding to said perturb voltage; and prevent a pre-determined number of successive increases or successive decreases in said previously produced reference voltage signal, wherein said preventing includes said processor being operably configured to:

store a previously calculated converter power value;

compare said calculated converter power value with said previously calculated power value to determine whether said calculated converter power value is increasing or decreasing; count successive increases in said calculated converter power value to produce a direction count value;

change a sign of a direction variable when said direction count value meets a criterion;

produce a perturb voltage addend as the product of said direction variable and said perturb voltage;

add said perturb voltage addend to said previously calculated reference voltage signal to produce a new reference voltage value; and produce said new reference voltage signal in response to said new reference voltage value.

24. The apparatus of claim 23 wherein said nonlinear function of converter power includes a piecewise linear function of converter power.

25. The apparatus of claim 23 wherein said nonlinear function of converter power includes a hyperbolic function of converter power.

26. The apparatus of claim 25 wherein said hyperbolic function is generally represented by: Vstep=((a/(b+Pconverter/c))−d; wherein Vstep=perturb voltage; Pconverter=Converter Power; a=a variable between about 5 and about 9; b=a variable between 0 and about 3; c=a variable between about 1000 and about 2000; and d=a variable between about 1 and about 3.

27. An apparatus for controlling the amount of power drawn from an energy converter, the apparatus comprising:

means for measuring an output voltage and an output current of the energy converter to produce signals representing converter output voltage and converter output current;

means for calculating converter power from the product of said converter output voltage and said converter output current;

means for calculating a perturb voltage as a decreasing nonlinear function of said converter power; and means for producing a new reference voltage signal representing a desired converter output voltage, in response to a previous reference voltage signal and said perturb voltage, for use by a switching circuit to adjust the power drawn from the converter to achieve said desired converter output voltage, wherein said decreasing nonlinear function includes a hyperbolic function of converter power, said hyperbolic function being generally represented by: Vstep=((a/(b+Pconverter/c))−d; wherein Vstep=perturb voltage; Pconverter=Converter Power; a=a variable between about 5 and about 9; b=a variable between 0 and about 3; c=a variable between about 1000 and about 2000; and d=a variable between about 1 and about 3.

28. The apparatus of claim 27 wherein means for measuring said output voltage and measuring said output current comprises sampling said output voltage and sampling said output current to produce sampled voltage and sampled current values.

29. The apparatus of claim 28 further comprising:

means for calculating converter power sample values in response to corresponding sampled voltage and sampled current values;

means for accumulating a plurality of successive power sample values for a period of time dependent upon said power sample values; and means for determining an average power value in response to said plurality of successive power sample values accumulated during said period of time.

30. The apparatus of claim 29 wherein said period of time is inversely proportional to a power represented by at least one of said power sample values.

31. The apparatus of claim 29 further comprising: means for classifying said power sample values into one of a plurality of power value ranges and setting said period of time according to a current power sample value range.

32. The apparatus of claim 27 further comprising means for normalizing said perturb voltage and clamping said perturb voltage within a range.

33. The apparatus of claim 27 wherein means for producing said reference voltage signal comprises increasing or decreasing a previously produced reference voltage signal by an amount corresponding to said perturb voltage.

34. The apparatus of claim 33 further comprising means for preventing a pre-determined number of successive increases or successive decreases in said previously produced reference voltage signal.

35. The apparatus of claim 27 further comprising means for providing said reference voltage signal to the switching circuit.

36. An apparatus for controlling the amount of power drawn from an energy converter, the apparatus comprising:

means for measuring an output voltage and an output current of the energy converter to produce signals representing converter output voltage and converter output current;

means for calculating converter power from the product of said converter output voltage and said converter output current;

means for calculating a perturb voltage as a decreasing nonlinear function of said converter power;

means for producing a new reference voltage signal representing a desired converter output voltage, in response to a previous reference voltage signal and said perturb voltage, for use by a switching circuit to adjust the power drawn from the converter to achieve said desired converter output voltage, said means for producing said new reference voltage signal increasing or decreasing a previously produced reference voltage signal by an amount corresponding to said perturb voltage; and means for preventing a pre-determined number of successive increases or successive decreases in said previously produced reference voltage signal, wherein said means for preventing said pre-determined number of successive increases or successive decreases comprises:

means for storing a previously calculated converter power value;

means for comparing said calculated converter power value with said previously calculated power value to determine whether said calculated converter power value is increasing or decreasing;

means for counting successive increases in said calculated converter power value to produce a direction count value; means for changing a sign of a direction variable when said direction count value meets a criterion;

means for producing a perturb voltage addend as the product of said direction variable and said perturb voltage; means for adding said perturb voltage addend to said previously calculated reference voltage signal to produce a new reference voltage value; and means for producing said new reference voltage signal in response to said new reference voltage value.

37. The apparatus of claim 36 wherein said nonlinear function of converter power includes a piecewise linear function of converter power.

38. The apparatus of claim 36 wherein said nonlinear function of converter power includes a hyperbolic function of converter power.

39. The apparatus of claim 38 wherein said hyperbolic function is generally represented by: Vstep=((a/(b+Pconverter/c))−d; wherein Vstep=perturb voltage; Pconverter=Converter Power; a=a variable between about 5 and about 9; b=a variable between 0 and about 3; c=a variable between about 1000 and about 2000; and d=a variable between about 1 and about 3.

40. A computer readable medium encoded with codes for directing a processor to produce a signal for controlling a switching circuit controlling the amount of power drawn from an energy converter, the codes comprising codes for directing the processor to:

receive signals representing converter output voltage and converter output current;

calculate a converter power value from the product of said converter output voltage and said converter output current;

calculate a perturb voltage as a decreasing nonlinear function of said converter power; and produce a new reference voltage signal representing a desired converter output voltage, in response to a previous reference voltage signal and said perturb voltage, for use by the switching circuit to adjust the power drawn from the converter to achieve said desired converter output voltage wherein said decreasing nonlinear function includes a hyperbolic function of converter power, said hyperbolic function being generally represented by: Vstep=((a/(b+Pconverter/c))−d; wherein Vstep=perturb voltage; Pconverter=Converter Power; a=a variable between about 5 and about 9; b=a variable between 0 and about 3; c=a variable between about 1000 and about 2000; and d=a variable between about 1 and about 3.

41. The computer readable medium of claim 40 wherein the signals representing converter output voltage and converter output current are sampled output voltage and sampled output current signals respectively.

42. The computer readable medium of claim 41 further comprising codes for directing the processor to:

calculate converter power sample values in response to corresponding sampled voltage and sampled current values;

accumulate a plurality of successive power sample values for a period of time dependent upon said power sample values; and determine an average power value in response to said plurality of successive power sample values accumulated during said period of time.

43. The computer readable medium of claim 42 wherein said period of time is inversely proportional to a power represented by at least one of said power sample values.

44. The computer readable medium of claim 42 further comprising codes for directing the processor to classify said power sample values into one of a plurality of power value ranges and setting said period of time according to a current power sample value range.

45. The computer readable medium of claim 40 further comprising codes for directing the processor to normalize said perturb voltage and clamp said perturb voltage within a range.

46. The computer readable medium of claim 40 further comprising codes for directing the processor to increase or decrease a previously produced reference voltage signal by an amount corresponding to said perturb voltage.

47. The computer readable medium of claim 46 further comprising codes for directing the processor to prevent a pre-determined number of successive increases or successive decreases in said previously produced reference voltage signal.

48. The computer readable medium of claim 40 further comprising codes directing the processor to provide said reference voltage signal to the switching circuit.

49. A computer readable medium encoded with codes for directing a processor to produce a signal for controlling a switching circuit controlling the amount of power drawn from an energy converter, the codes comprising codes for directing the processor to:

receive signals representing converter output voltage and converter output current;

calculate a converter power value from the product of said converter output voltage and said converter output current;

calculate a perturb voltage as a decreasing nonlinear function of said converter power;

produce a new reference voltage signal representing a desired converter output voltage, in response to a previous reference voltage signal and said perturb voltage, for use by the switching circuit to adjust the power drawn from the converter to achieve said desired converter output voltage;

increase or decrease a previously produced reference voltage signal by an amount corresponding to said perturb voltage;

store a previously calculated converter power value;

compare said calculated converter power value with said previously calculated power value to determine whether said calculated converter power value is increasing or decreasing;

count successive increases in calculated power value to produce a direction count value;

change a sign of a direction variable when said direction count value meets a criterion;

produce a perturb voltage addend as the product of said direction variable and said perturb voltage;

add said perturb voltage addend to said previously calculated reference voltage signal to produce a new reference voltage value; and produce said new reference voltage signal in response to said new reference voltage value.

50. The computer readable medium of claim 49 wherein said nonlinear function of converter power includes a piecewise linear function of converter power.

51. The computer readable medium of claim 49 wherein said nonlinear function of converter power includes a hyperbolic function of converter power.

52. The computer readable medium of claim 51 wherein said hyperbolic function is generally represented by: Vstep=((a/(b+Pconverter/c))−d; wherein Vstep=perturb voltage; Pconverter=Converter Power; a=a variable between about 5 and about 9; b=a variable between 0 and about 3; c=a variable between about 1000 and about 2000; and d=a variable between about 1 and about 3.

* * * * *